US008997442B2

(12) United States Patent
Wadsworth et al.

(10) Patent No.: US 8,997,442 B2
(45) Date of Patent: Apr. 7, 2015

(54) SHIPPING SYSTEM FOR PLANTS OR OTHER ITEMS

(75) Inventors: David N. Wadsworth, Homestead, FL (US); Timothy Ralph Masarik, Litchfield, MI (US)

(73) Assignee: C. Raker & Sons, Inc., Litchfield, MI (US)

( * ) Notice: Subject to any disclaimer, the term of this patent is extended or adjusted under 35 U.S.C. 154(b) by 125 days.

(21) Appl. No.: 13/352,761

(22) Filed: Jan. 18, 2012

(65) Prior Publication Data

US 2013/0126373 A1 May 23, 2013

Related U.S. Application Data

(60) Provisional application No. 61/439,533, filed on Feb. 4, 2011.

(51) Int. Cl.

| | |
|---|---|
| ***B65B 43/00*** | (2006.01) |
| ***B31B 11/00*** | (2006.01) |
| ***B65B 5/10*** | (2006.01) |
| ***B65D 5/00*** | (2006.01) |
| ***B65D 5/32*** | (2006.01) |
| ***B65D 5/42*** | (2006.01) |
| ***B65D 5/498*** | (2006.01) |
| ***B65D 85/52*** | (2006.01) |

(52) U.S. Cl.

CPC ..... *B65D 5/003* (2013.01); *B31B 11/00* (2013.01); *B65B 5/10* (2013.01); *B65D 5/324* (2013.01); *B65D 5/4295* (2013.01); *B65D 5/48048* (2013.01); *B65D 85/52* (2013.01)

(58) Field of Classification Search

USPC ..... 53/452, 456, 376.3, 246; 493/90, 92

See application file for complete search history.

(56) References Cited

U.S. PATENT DOCUMENTS

| | | | | | |
|---|---|---|---|---|---|
| 3,185,379 | A * | 5/1965 | Kohlhaas | 206/599 |
| 3,967,772 | A * | 7/1976 | Baker | 229/110 |
| 4,037,775 | A * | 7/1977 | Bamburg et al. | 229/120.37 |
| 4,082,214 | A * | 4/1978 | Baker | 229/120.01 |
| 4,235,158 | A * | 11/1980 | Johnson, Jr. | 493/334 |
| 4,309,175 | A * | 1/1982 | Martin | 493/92 |
| 4,310,323 | A * | 1/1982 | Moen | 493/92 |
| 4,315,752 | A * | 2/1982 | Moen | 493/171 |
| 4,398,901 | A * | 8/1983 | Campbell | 493/90 |
| 4,601,687 | A * | 7/1986 | Gallaher | 493/89 |
| 4,697,699 | A * | 10/1987 | Schneider | 206/735 |
| 5,316,210 | A * | 5/1994 | Scullin | 229/117.16 |
| 5,601,521 | A * | 2/1997 | Plamas Xapelli | 493/346 |
| 5,758,818 | A * | 6/1998 | Ewing, Jr. | 229/120.011 |
| 5,950,915 | A * | 9/1999 | Moen | 229/122.24 |
| 6,244,502 | B1 * | 6/2001 | Hollar et al. | 229/120.011 |
| 6,296,119 | B1 * | 10/2001 | Wells | 206/423 |
| 6,520,898 | B1 * | 2/2003 | Moen | 493/52 |
| 7,775,419 | B2 * | 8/2010 | Bale | 229/120.36 |

* cited by examiner

*Primary Examiner* — Christopher Harmon
(74) *Attorney, Agent, or Firm* — Price Heneveld LLP

(57) ABSTRACT

A stackable shipping unit includes a plurality of individual components that may be partially assembled, then packed with items to be shipped. The shipping unit can then be fully assembled, and placed on a pallet. The shipping system may include trays that can be used as either a base or a lid. The unit includes vertical components that are generally U-shaped in plan view, and sized to fit closely within the trays in pairs to form a "H" shape in plan view forming a pair of shipping spaces. Additional U-shaped vertical components can then be assembled to close off the shipping spaces, and a tray can be used as a lid and positioned on top of the vertical components to form an assembled shipping unit.

17 Claims, 5 Drawing Sheets

SHIPPING SYSTEM FOR PLANTS OR OTHER ITEMS

CROSS REFERENCE TO RELATED APPLICATIONS

This application claims the benefit of U.S. provisional patent application No. 61/439,533 filed on Feb. 4, 2011, entitled "SHIPPING SYSTEM FOR PLANTS OR OTHER ITEMS," the entire contents of which is incorporated by reference.

BACKGROUND OF THE INVENTION

Perishable items such as plants or the like have been shipped in boxes. The boxes are loaded on a pallet, and the pallet is then loaded into a truck or other vehicle for shipping. Refrigerated trucks are often utilized to ship plants or other perishable items.

In general, a greenhouse or other supplier of plants will offer a variety of plants in different sized pots or other containers. Also, the plants themselves may vary substantially in size. Typically, a customer places an order for plants that includes plants of different species that are supplied in pots of different sizes. If cardboard boxes or other conventional containers are used for shipping, large and small plants may be placed together in a box in order to fill a specific order. However, the box may be larger than necessary for some of the plant species, leading to inefficient use of the space within the boxes. Also, the boxes may be time consuming to load, and/or difficult to position in a truck without damage to the plants or box.

SUMMARY OF THE INVENTION

One aspect of the present invention is a shipping unit configured to be positioned on a pallet. The shipping unit includes a plurality of individual components made from cardboard or other suitable material that may be partially assembled prior to packing with plants or other items. The shipping unit can then be fully assembled, and placed on a pallet. Additional fully assembled shipping units may then be stacked onto the fully assembled unit. The components making up the individual shipping units may be prefabricated in a variety of sizes, such that the size of the shipping unit can be adjusted as required at the time of assembly to meet the requirements of a particular order of plants or other items. The height of the vertical components of the assembled units in a stack may be selected to provide for a total height of 96 inches, which corresponds to the maximum allowable height for many refrigerated trucks.

The shipping system may include trays that are made of cardboard or other suitable material generally shaped similar to shallow boxes. The trays can be used as either a base or a lid. The trays preferably have a size corresponding to a standard pallet. The shipping system also includes a plurality of vertical components that are also made of cardboard or other suitable material. The vertical components are generally U-shaped in plan view, and sized to fit closely within the trays. A first pair of the vertical components may be placed in a tray forming a base, with the vertical components being positioned to form an "H" shape in plan view, with the "horizontal" leg of the "H" dividing the space above the tray into two side-by-side spaces that receive plants or other items therein. Additional U-shaped vertical components can then be assembled to close off the spaces, and a tray can be used as a lid and positioned on the top of the vertical components to form an assembled unit.

DETAILED DESCRIPTION OF PREFERRED EMBODIMENTS

Figure 1:
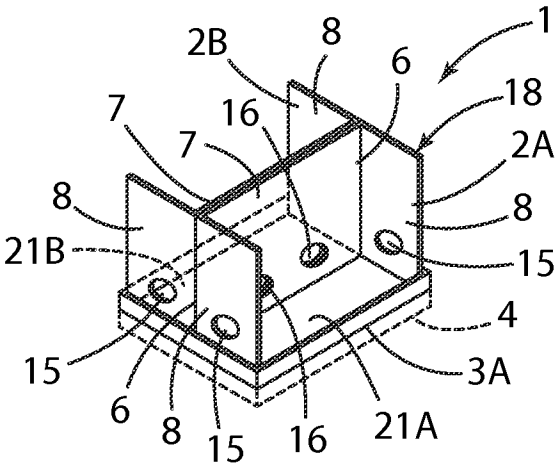
FIG. 1 is an isometric view of a partially assembled shipping unit according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
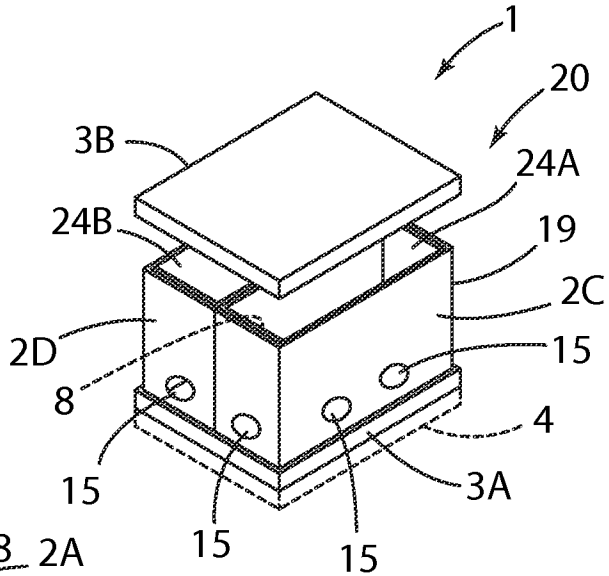
FIG. 3 is an isometric view of a partially assembled shipping unit.

With reference to FIGS. 1-4, a shipping system 1 according to the present invention includes a plurality of U-shaped components ("shrouds") 2 and a plurality of trays 3 that can be utilized as a base 3A (FIG. 1) or a lid 3B (FIG. 3). The individual shrouds 2 are designated 2A, 2B, 2C, and 2D, and the individual trays 3 are designated 3A, 3B, 3C, 3D, and 3E. Tray 3A may be positioned on a conventional pallet 4 of the type used to transport plants or other items in refrigerated trucks or other such shipping vehicles. The trays 3A-3E preferably have a length "L" (FIG. 4) and a width "W" (FIG. 5) of about 48 inches and about 40 inches, respectively, to match the size of a conventional pallet 4 in plan view.

Figure 2:
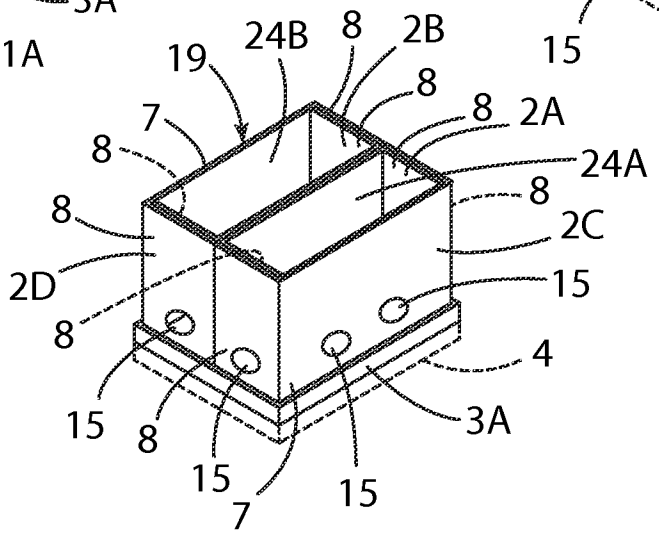
FIG. 2 is an isometric view of a partially assembled shipping unit.

The U-shaped shroud components 2A-2D of FIGS. 1-3 are identical to one another. As discussed in more detail below in connection with FIGS. 7-11, the shroud components 2A-2D comprise sheets of cardboard that are folded along fold lines 6 to form a base 7 and extensions 8 that extend from the base 7 at about a 90 degree angle. U-shaped shroud components 2A-2D may include one or more openings 15 through extensions 8, and one or more openings 16 through the base 7. The openings 15 and 16 provide for circulation of air around plants or other items placed within an assembled shipping unit 20 (FIG. 3) and also provide for visual inspection of the items within shipping unit 20. The trays 3A and 3B are substantially identical to one another, and include a flat base 9 (see also FIG. 4) and upstanding sidewalls 10-13. The trays 3A, 3B, etc. are also preferably made from cardboard, or other such suitable material.

During assembly, a pair of U-shaped shroud components 2A and 2B are positioned on a tray 3A, with the bases 7 of U-shaped shroud components 2A-2D in contact with each other such that the components 2A and 2B have a "H" shape in plan view. The U-shaped shroud components 2A and 2B form two discrete areas 21 of tray 3A. Once a partially assembled unit 18 (FIG. 1) is formed, one or more plants (e.g., in pots) can be positioned in spaces 21A and 21B on tray 3A. The plants may be positioned according to the type or size of plant. For example, only plants of a first size or type may be positioned in spaces 21A, and plants of a second size or type may be positioned in space 21B.

After the plants are loaded onto the partially assembled unit 18, additional U-shaped shroud components 2C and 2D are positioned on the tray 3A, with the extensions 8 of U-shaped shroud components 2A and 2C overlapping one another. The extensions 8 of the outer U-shaped shroud components 2C and 2D can be positioned either outside or inside extensions 8 of the inner U-shaped shroud components 2A and 2B. Similarly, the extensions 8 of U-shaped shroud components 2B and 2D also overlap one another. The bases 7 of U-shaped shroud components 2C and 2D close off the spaces 21A and 21B to form a partially assembled unit 19 having a quadrilateral perimeter with vertically-extending spaces 24A and 24B.

Figure 4:
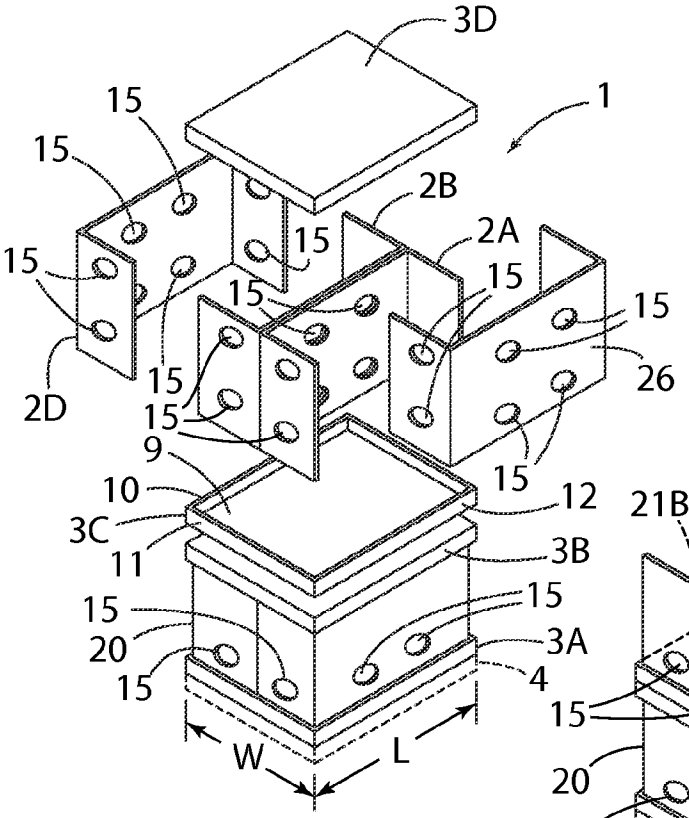
FIG. 4 is an isometric view of an assembled lower shipping unit, showing a second shipping unit in an exploded isometric configuration above the first shipping unit.

After assembly of the partially assembled unit 19 (FIG. 2), an upper tray 3B (FIG. 3) is positioned on the U-shaped components 2A-2D to close off the spaces 24A and 24B to form an assembled shipping unit 20 (see also FIG. 4).

Figure 5:
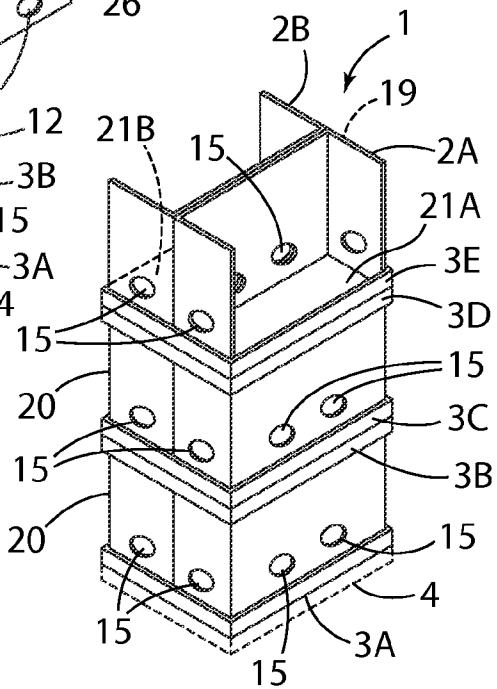
FIG. 5 is an isometric view of first and second assembled shipping units that are stacked on top of one another, with a partially assembled third shipping unit positioned on top of the first and second shipping units.

After completion of a fully assembled lower shipping unit 20, an additional tray 3C can be positioned on the tray 3B as shown in FIG. 4. Additional U-shaped shroud components 2A and 2B are then positioned on tray 3C in substantially the same manner as described above in connection with FIG. 1. This forms a second partially assembled unit (not shown) that is substantially similar to the partially assembled unit 18 of FIG. 1. Additional plants or other items are then loaded onto the tray 3C, and additional U-shaped shroud components 2C and 2D are then positioned on tray 3C. An upper tray 3D is then positioned on the U-shaped shroud components 2A-2D to form another assembled shipping unit 20 as shown in FIG. 5. Additional U-shaped shroud components 2A-2D (see also FIG. 6) can then be positioned on another tray 3E, with additional plants or other such items positioned in the spaces 21A and 21B.

The height "H" (FIG. 6) of the U-shaped components 2 may be selected to provide for shipping of plants or other items having different heights. For example, a plurality of U-shaped shroud components 2A-2D having heights of 16 inches, 24 inches, 32 inches, 36 inches, and 48 inches may be prefabricated, and used as needed to provide the required height. Various combinations of U-shaped components 2 may be utilized to provide a stack of units 20 having a 96 inch total height corresponding to the maximum allowable height of refrigerated trucks and the like used for shipping.

For example, two assembled shipping units 20 having heights of 48 inches may be stacked to provide a total height of 96 inches. Similarly, 48 inch high assembled shipping unit 20 may be stacked with a 32 inch assembled unit and a 16 inch assembled unit to provide for a 96 inch total height. The following combinations of height also provide a 96 inch total height: (24", 24", 48"), (16", 16", 16", 48"), (24", 36", 36"), (32", 32", 32"), (16", 24", 24", 32"), (16", 16", 16", 16", 32"), (24", 24", 24", 24"), (16", 16", 16", 24", 24"), (16", 16", 16", 16", 16", 16").

Flat shroud components (i.e. prior to folding) for 16", 24", 32", 36", and 48" high shrouds are shown in FIGS. 7-11, respectively. The shrouds of FIGS. 7-11 are preferably made of a commercially-available cardboard material having a 2701*b* burst/crush test rating, with a MRA and Michelman 40E tinted coating to improve the water repellency and strength of the shrouds. It will be understood that various other suitable materials may also be utilized to construct the shrouds.

Figure 7:
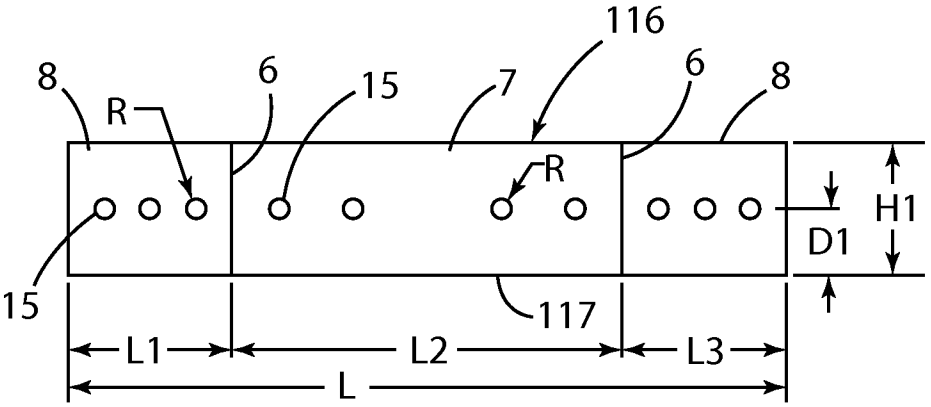
FIG. 7 is a plan view of a 16" shroud prior to folding.

With reference to FIG. 7, a 16 inch high shroud 116 has an overall length "L" of 83 15/16 inches, a length "L1" to fold line 6 of 19⅛ inches, a center dimension "L2" of 45 11/16 inches, and a dimension "L3" of 19⅛ inch. The dimensions L, L1, L2, and L3 are the same for all of the shrouds shown in FIGS. 7-11.

The height dimension "H1" of the shroud 116 is 15 inches. The dimension H1 is slightly less than the nominal height (16 inches) of shroud 116 to account for the thicknesses of trays 3 and provide an overall height of an assembled unit 20 that is about 16 inches. Openings 15 have a radius "R" of 1⅛. The openings 15 are located at a distance "D1" of 7½ inches from edge 117 of shroud 116.

Figure 8:
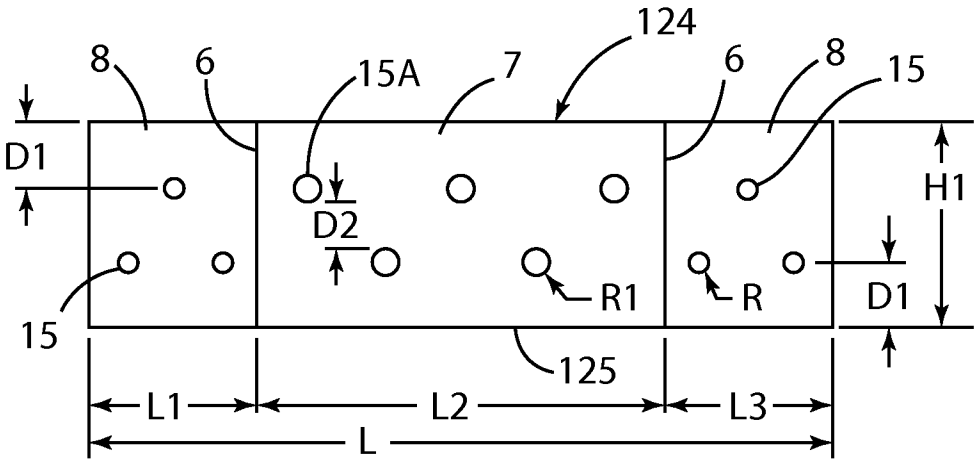
FIG. 8 is a plan view of a 24" shroud prior to folding.

With reference to FIG. 8, a 24 inch shroud 124 has a dimension "H2" of 22⅞ inches. A plurality of openings 15 in end portions 8 have a radius R of 1⅛, and openings 15A in center portion 7 have a radius "R1" of 1½. Dimension "D1" is 7½ inches, and a dimension "D2" between edges of adjacent openings 15A is 5 inche.

Figure 9:
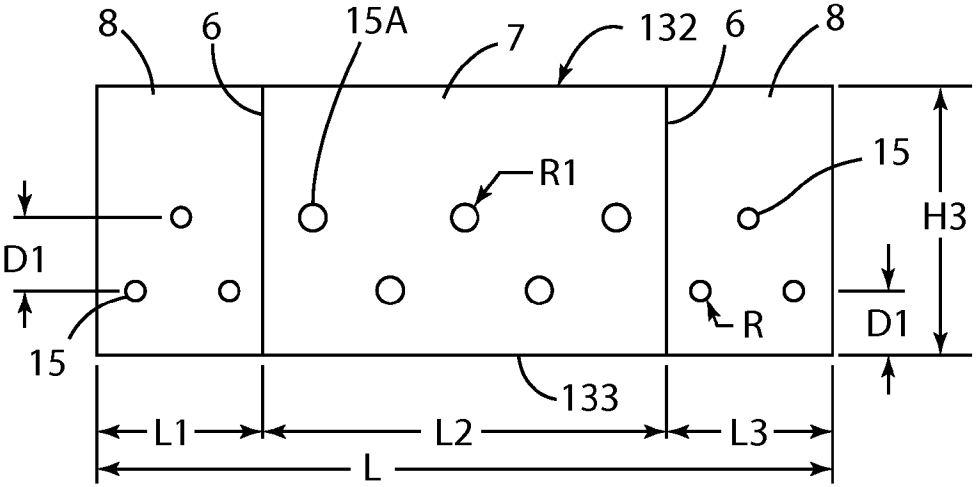
FIG. 9 is a plan view of a 32" shroud prior to folding.

With further reference to FIG. 9, a 32 inch shroud 132 has a height "H3" of 30¾ inches, and a plurality of openings 15 in end portions 8 having a radius R of 1⅛. A plurality of openings 15A in center section 7 have a radius R1 of 1½. The openings are spaced apart vertically by dimension D1, wherein D1 is 7½ inches.

Figure 10:
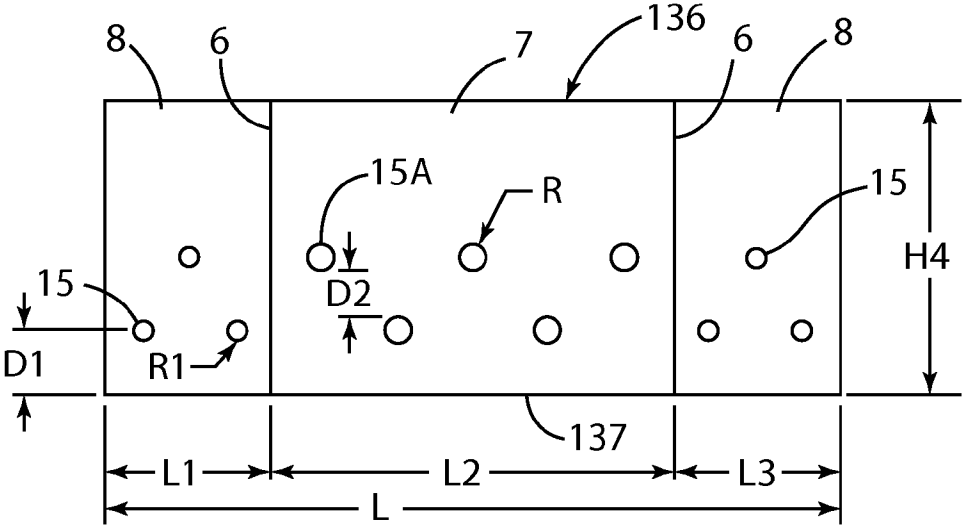
FIG. 10 is a plan view of a 36" shroud prior to folding.

With reference to FIG. 10, a 36 inch shroud 136 has a height "H4" of 34⅜ inches, and includes a plurality of openings 15 in end portions 8 having a radius R of 1⅛ inches. Openings 15 and 15A are spaced apart from a lower edge 137 by a dimension D1 of 7½ inches, and the edges of openings 15A are spaced apart a vertical distance D2 of 5 inches.

Figure 11:
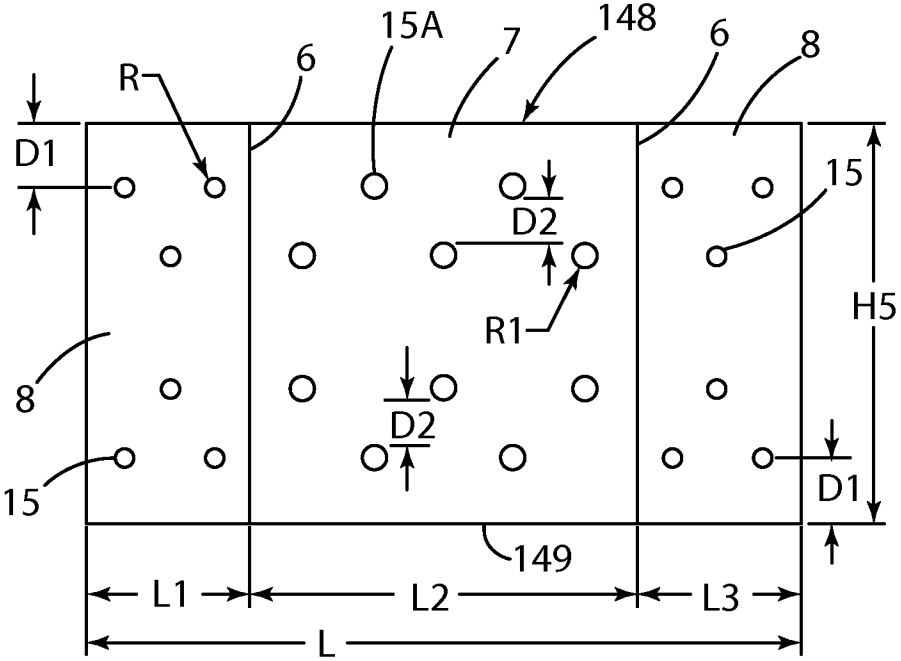
FIG. 11 is a plan view of a 48" shroud prior to folding.

With further reference to FIG. 11, a 48 inch high shroud 148 has a dimension "H5" of 46⅜ inches. Shroud 148 includes a plurality of openings 15 having a radius R of 1⅛ through end portions 8, and a plurality of openings 15A in center portion 7 having a dimension R1 of 1½. The openings are spaced as shown by the dimensions D1 (7½ inches), and D2 (5 inches).

The dimensions H1, H2, H3, H4, and H5 of FIGS. 7-11, respectively are selected to provide an overall height of an assembled unit 20 corresponding to the nominal size of the shroud. This permits the combinations of heights noted above to provide a 96 inch total height. Dimensions H1-H5 may be selected based on the thickness of the materials utilized to form the trays 3. The dimensions H1-H5 may also be selected to provide slightly less than the nominal overall dimension, such that a plurality of assembled units 20 have an overall height that is slightly less than 96 inches to provide clearance when stacked for shipping in a standard 96 inch high refrigerated shipping space.

One or more pallets 4 may be utilized for an order from a greenhouse or other such supplier. For example, an order could include a first pallet having one 48 inch high shipping unit 20, one 32 inch high shipping unit 20, and one 16 inch high shipping unit 20. A second pallet utilized for the same order could include one 48 inch high shipping unit 20, and two 24 inch high shipping units 20, and a third pallet could include two 32 inch high shipping units 20 and two 16 inch high shipping units 20. A fourth pallet used for the order could utilize one 32 inch high shipping unit 20, two 24 inch high shipping units 20, and one 16 inch high shipping unit 20. In this way, an order of plants or other items having several different heights can be readily combined to provide for efficient use of space in a truck or other shipping vehicle. Also, the number and type of plants included in an order may be adjusted or changed to provide for efficient use of the shipping system, and thereby minimize the shipping costs.

If the shipping system is utilized to ship plants, the 16 inch high shipping units 20 can be utilized to ship eighty 4.5 inch pots, with a first group of forty pots in the space 21A (FIG. 1), and a second group of forty pots in space 21B. In this example, each group of forty pots includes four rows of 10 pots.

The 24 inch high shipping units 20 may be utilized to transport or ship 6 inch pots comprising two groups of twenty-one pots. Each twenty-one pot group comprises three rows of seven pots, with each group of twenty-one pots being positioned in an area 21A and an area 21B.

The 32 inch high shipping units 20 may be packed in a first configuration including 10 inch plants arranged in groups of eight in the spaces 21A and 21B. A second potential configuration for the 32 inch high shipping units 20 comprises 6 inch pots of plant varieties or other items that are extra tall, and therefore require a 32 inch high shipping unit 20. In this configuration, six pots may be placed in area 21A, and another six pots may be placed in area 21B.

A 32 inch high shipping unit 20 may also be utilized to ship hanging baskets of different sizes. For example, ten 12 inch hanging baskets can be combined with twelve 6 inch plants to provide for twenty-two pots total in a shipping unit 20. Five of the 12 inch hanging baskets can be positioned in space 21A, and six of the 6 inch hanging baskets can be positioned in the area 21A. Similarly, five of the 12 inch hanging baskets and six of the 6 inch baskets can be positioned in space 21B. Nesting of the baskets in a single shipping unit 20 increases the density to reduce the packaging and freight expenses per plant or other item.

It will be readily apparent that various other combinations may be utilized as required to meet the needs of a particular order.

According to one aspect of the present invention, a customer may be provided with information concerning the combination of heights of shipping units 20 that can be utilized on a single pallet, and the customer can also be provided with the plant combinations that are possible for each height shipping unit 20. In this way, a customer can place an order that provides for one or more pallets, each of which is preferably configured to have the maximum allowable height of 96 inches.

Figure 6:
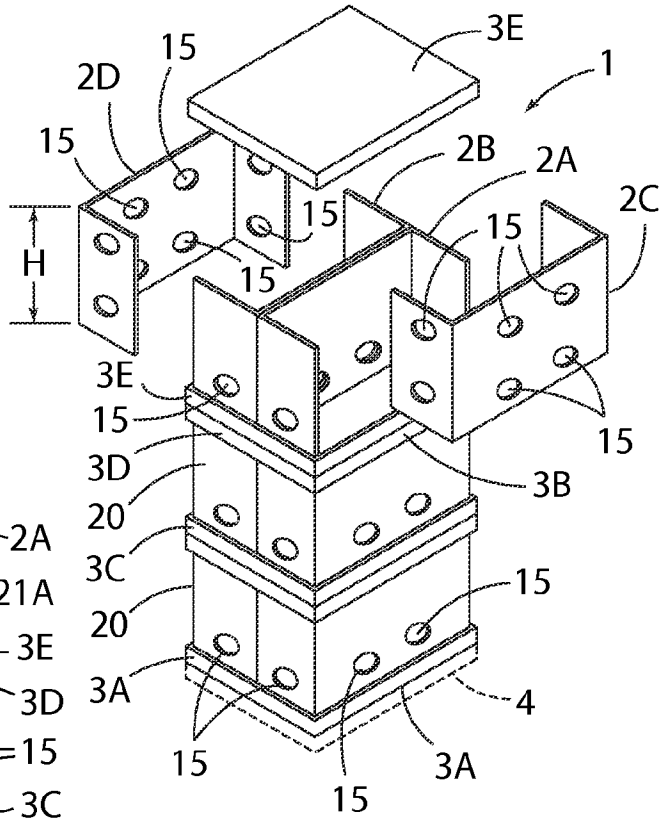
FIG. 6 is an isometric view of a partially assembled shipping unit according to one aspect of the present invention, showing additional components of the uppermost shipping most in an exploded isometric configuration.

The U-shaped components 2A-2D for the lowermost assembled shipping unit 20 (FIG. 3) may be selected to accommodate the height of the plants positioned in the shipping unit 20 of FIG. 3. If plants of a different height are placed in the next unit, the U-shaped components 2A-2D may be selected to accommodate plants of a different height than the plants positioned in the lowermost shipping unit 20. In this way, the heights of the completed shipping units 20 can be selected to accommodate plants or other items of different sizes, and the various shipping units 20 can all be stacked on top of one another as shown in FIG. 6.

Also, the assembled shipping units 20 (e.g., FIG. 3) may be formed without the outer most U-shaped components 2C and 2D, such that plants positioned in the spaces 21A and 21B can be accessed from an assembled unit 20 without removing the upper tray/lid 3. For example, the tray 3B (FIG. 3) may be placed directly on the partially assembled unit 18 of FIG. 1, without first positioning the U-shaped components 2C and 2D of FIG. 2 on tray 3A. Also, if required, the outer U-shaped members 2C and 2D may be removed from a lower assembled shipping unit 20 (e.g., the lowermost two units of FIG. 6). For example, the cardboard material may be cut, and one or more of the outer U-shaped components 2 can be removed.

The shipping system of the present invention provides for faster loading of plants or other items, and also provides for efficient use of space. The system also maximizes packing density and thereby reduces the cost associated with packaging, handling, and freight.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A method of forming shipping containers, comprising:

providing a plurality of horizontal members having quadrilateral perimeters and upstanding edge walls extending around the perimeter to define an outwardly-opening space;

providing first, second, third, and fourth upstanding dividers, each having a U-shape in plan view formed by a central wall and transverse end walls, wherein the first, second, third, and fourth upstanding dividers are substantially identical to one another;

positioning first and second dividers on a horizontal member that has been positioned for use as a base with the space opening upwardly and receiving lower edge portions of the first and second dividers therein, wherein the central walls of the first and second dividers extend across a central portion of the horizontal member to define side-by-side shipping spaces, and wherein the end walls of the dividers extend along inside surfaces of a selected pair of the edge walls;

positioning items to be shipped in the shipping spaces;

positioning the third and fourth dividers adjacent the first and second dividers, respectively, with end walls of the first and third dividers overlapping, and wherein end walls of the second and fourth dividers overlap; and:

positioning a horizontal member on top of the dividers to form an assembled container.

2. A method of forming shipping containers, comprising:

providing a plurality of horizontal members having quadrilateral perimeters and upstanding edge walls extending around the perimeter to define an outwardly-opening space;

providing a plurality of upstanding dividers, each having a U-shape in plan view formed by a central wall and transverse end walls;

positioning first and second dividers on a horizontal member that has been positioned for use as a base with the space opening upwardly and receiving lower edge portions of the first and second dividers therein, wherein the central walls of the first and second dividers extend across a central portion of the horizontal member to define side-by-side shipping spaces, and wherein the end walls of the dividers extend along inside surfaces of a selected pair of the edge walls;

positioning items to be shipped in the shipping spaces;

positioning third and fourth dividers adjacent the first and second dividers, respectively, with end walls of the first and third dividers overlap, and wherein end walls of the second and fourth dividers overlap;

positioning a horizontal member on top of the dividers to form an assembled container;

providing at least four first dividers having a first height and a first shape in plan view;

providing at least four second dividers having the first shape in plan view and having a second height that is not equal to the first height;

providing a plurality of horizontal members that can be used as covers and bases with both the first dividers and the second dividers;

assembling at least first and second containers having the first and second heights; and positioning at least one second assembled container on top of the first assembled container to form a stack of containers.

3. The method of claim 2, wherein:

the heights of the first and second assembled containers can be combined to provide an overall height that is about ninety-six inches.

4. The method of claim 3, wherein:

the first height comprises twenty-four inches, and the second height comprises forty-eight inches, and wherein:

the stack comprises two of the first containers and one of the second containers.

5. The method of claim 1, wherein:

the assembled container has a height of about sixteen inches, and including:

assembling at least six containers utilizing substantially identical horizontal members and dividers;

stacking the containers to form a stack having a height of about ninety-six inches.

6. The method claim 1, including:

providing a plurality of dividers that are sixteen inches high, twenty-four inches high, thirty-two inches high, thirty-six inches high, and forty-eight inches high;

selecting dividers having combinations of heights totaling about ninety-six;

assembling a plurality of containers;

positioning items to be shipped in each container;

stacking the containers.

7. The method of claim 6, including:

placing the containers in a vehicle at a first location;

transporting the containers to one or more delivery locations;

disassembling the containers;

transporting the containers back to the first location in a disassembled condition.

8. A method of forming shipping containers, comprising:

providing a plurality of horizontal members having quadrilateral perimeters and upstanding edge walls extending around the perimeter to define an outwardly-opening space;

providing a plurality of upstanding dividers, each having a U-shape in plan view formed by a central wall and transverse end walls;

positioning first and second dividers on a horizontal member that has been positioned for use as a base with the space opening upwardly and receiving lower edge portions of the first and second dividers therein, wherein the central walls of the first and second dividers extend across a central portion of the horizontal member to define side-by-side shipping spaces, and wherein the end walls of the dividers extend along inside surfaces of a selected pair of the edge walls;

positioning items to be shipped in the shipping spaces;

positioning third and fourth dividers adjacent the first and second dividers, respectively, with end walls of the first and third dividers overlap, and wherein end walls of the second and fourth dividers overlap;

positioning a horizontal member on top of the dividers to form an assembled container; and wherein:

the items to be shipped are positioned in the shipping spaces after the first and second dividers are positioned on the horizontal member, but before the third and fourth dividers are positioned on the horizontal member.

9. A method of forming a shipping container system for plants, comprising:

forming a base having a horizontal central sheet and upstanding edge walls defining a generally quadrilateral perimeter such that the base defines a shallow space that opens upwardly;

forming a vertical divider structure comprising at least first, second, third, and fourth upstanding dividers, each divider having an upstanding central wall with vertically extending opposite edge portions, each divider further including a pair of planar end walls extending transversely from the opposite edge portions of the central wall, wherein each pair of planar end walls are parallel to one another and define a horizontal dimension therebetween and vertical end edges such that each divider is generally U-shaped in plan view and defines upper and lower edge portions;

positioning the lower edge portions of the first and second dividers in the upwardly opening shallow space of the base inside the edge walls with the central walls of the first and second dividers being directly adjacent one another and extending across a central portion of the shallow space with the end walls of the first and second dividers extending in opposite directions just inside of the upstanding edge wails to thereby form an H-shape in plan view defining first and second spaces utilizing the first and second dividers, wherein the first and second spaces are separated by the adjacent central walls of the first and second dividers and wherein the vertical end edges define openings having a width equal to the horizontal dimension;

positioning the third divider adjacent the first divider with the central wall of the third divider being spaced apart from the central wall of the first divider with the end walls of the third divider overlapping the end walls of the first divider;

positioning the fourth divider adjacent the second divider with the central wall of the fourth divider being spaced apart from the central wall of the second divider with the end walls of the fourth divider overlapping the end walls of the second divider whereby the vertical divider structure defines a generally quadrilateral outer perimeter in plan view and a central space that is divided into first and second spaces by the central walls of the first and second dividers;

forming a cover having a generally quadrilateral perimeter and downwardly extending edge walls forming a shallow downwardly opening space;

positioning the cover on the vertical divider structure with a central portion of the cover extending over the upper end portions of the first, second, third, and fourth dividers.

10. The method of claim 9, including:

forming the end walls of the dividers in an orthogonal relationship relative to the central walls of each divider.

11. The method of claim 10, including;

forming the base and the cover to have substantially the same size and shape.

12. The method of claim 9, including:

removably engaging the dividers with the base and the cover;

disassembling the container without damaging the components forming the shipping container.

13. The method of claim 9, including:

folding thin sheets of material to form the base, cover, first divider, second divider, third divider, and fourth divider into their respective shapes.

14. The method of claim 13, wherein:

the thin sheets of material comprise cardboard.

15. The method of claim 9, including:

forming at least one enlarged opening that is about three inches across through at least one of the central wall and the end walls of at least one divider.

16. The method of claim 9, wherein:

the upstanding central wall and the end walls are formed from sheets having substantially planar opposite side surfaces and linear upper and lower edges.

17. The method of claim 9, including:

forming a second shipping container having substantially identical construction as the first shipping container; and:

stacking the second shipping container on top of the first shipping container.

* * * * *